US011505286B2

(12) United States Patent
Potts, I et al.

(10) Patent No.: US 11,505,286 B2
(45) **Date of Patent: *Nov. 22, 2022**

(54) BOW-MOUNTED DETECTING SYSTEM

(71) Applicant: Scout Boats, Inc., Summerville, SC (US)

(72) Inventors: Steven E. Potts, I, Summerville, SC (US); Steven E. Potts, II, Summerville, SC (US)

(73) Assignee: Scout Boats, Inc., Summerville, SC (US)

( * ) Notice: Subject to any disclaimer, the term of this patent is extended or adjusted under 35 U.S.C. 154(b) by 94 days.

This patent is subject to a terminal disclaimer.

(21) Appl. No.: 17/082,639

(22) Filed: Oct. 28, 2020

(65) Prior Publication Data

US 2021/0039752 A1 Feb. 11, 2021

Related U.S. Application Data

(63) Continuation of application No. 16/287,267, filed on Feb. 27, 2019, now Pat. No. 10,850,809.

(60) Provisional application No. 62/636,005, filed on Feb. 27, 2018.

(51) Int. Cl.

| | |
|---|---|
| ***B63B 21/24*** | (2006.01) |
| ***B63B 21/04*** | (2006.01) |
| ***B63B 21/20*** | (2006.01) |
| ***B63B 21/22*** | (2006.01) |
| ***B63B 49/00*** | (2006.01) |

(52) U.S. Cl.

CPC ..... *B63B 21/24* (2013.01); *B63B 21/04* (2013.01); *B63B 21/20* (2013.01); *B63B 21/22* (2013.01); *B63B 49/00* (2013.01)

(58) Field of Classification Search

CPC ..... B63B 21/00; B63B 21/04; B63B 21/20; B63B 21/22; B63B 21/24; B63B 49/00

USPC ..... 114/294; 701/21

See application file for complete search history.

(56) References Cited

U.S. PATENT DOCUMENTS 8,296,001 B1 * 10/2012 Kabel ..... G08G 3/02 701/21

FOREIGN PATENT DOCUMENTS

WO WO-2012148525 A1 * 11/2012 ..... B63B 21/22

* cited by examiner

*Primary Examiner* — Lars A Olson

(74) *Attorney, Agent, or Firm* — Womble Bond Dickinson (US) LLP; Ryan Cagle; John V. Forcier

(57) ABSTRACT

The present disclosure relates to water vessels with a bow-mounted detecting system and methods for monitoring movement of an anchor at a bow of a water vessel. More particularly, a water vessel as disclosed herein can include an anchor apparatus positioned in or on a hull of the water vessel at about a bow thereof, a detecting positioned in or on the hull of the water vessel at about the bow thereof and having a forward-directed field-of-view, and a display device adapted to receive from the detecting device and display one or more captured images of the forward scene. A method as disclosed herein can comprise providing a water vessel as disclosed herein, activating the display device to display the one or more captured images, and activating the anchor apparatus so as to cause motorized deployment or retrieval of an anchor. The water vessel can particularly provide for real-time monitoring of deploying and/or retrieving an anchor using the detecting device and the display device.

15 Claims, 8 Drawing Sheets

BOW-MOUNTED DETECTING SYSTEM

CROSS-REFERENCE TO RELATED APPLICATIONS

The present application is a continuation of U.S. patent application Ser. No. 16/287,267, filed Feb. 27, 2019, which claims priority to U.S. Provisional Patent Application No. 62/636,005, filed Feb. 27, 2018, the disclosures of which are incorporated herein by reference in their entireties.

FIELD OF THE DISCLOSURE

The present disclosure relates to water vessels. More particularly, the present disclosure relates to water vessels (e.g., boats or ships) that include a bow-mounted detecting system.

BACKGROUND

Anchor apparatuses of water vessels, such as boats and ships, have previously been configured so that the anchor may be manually deployed and/or retrieved from a deck of the water vessel over a side of the water vessel. Anchor apparatuses allowing for motorized deployment and retrieval are typically mounted in water vessels so that motorized components are positioned within a wall of the water vessel, and the anchor itself extends out of an outer surface of the wall. Typically, the anchor is positioned at the bow of the water vessel. As such, in a retracted position, an anchor apparatus is disposed adjacent to the bow of the water vessel and in a deployed position the anchor apparatus is disposed at a distance away from the bow.

Such positioning of anchor apparatuses for motorized deployment and retrieval provide convenience in that a person is not required to manually "toss out" the anchor and/or "pull in" the anchor by hand. Such positioning of the anchor apparatus for motorized deployment and retrieval, however, can also lead to certain inconveniences. For example, it may be difficult to control anchor apparatuses between the retracted positions and the deployed positions, and vice versa, as the bows of the water vessels are usually angled such that occupants of these water vessels cannot view the anchor apparatuses moving between the two positions. Since a water vessel can often drift while anchored, it can often be difficult to tell from which direction the anchor is being retrieved, and this can lead to possible tangling of the anchor attachment (e.g., rope or chain) or even damage to the water vessel or capsizing of the water vessel. Accordingly, even though a motorized anchor apparatus can allow for deployment and/or retrieval of the anchor by simply pressing a button from the bridge or main control panel of the water vessel, a person may be required to monitor status of the anchor retrieval by leaning over the bow of the water vessel to physically monitor the position of the anchor. This, of course, can be inconvenient as well as dangerous. Thus, advances with respect to bow-mounted detecting systems for detecting the anchor apparatuses in the two positions may be desirable.

BRIEF SUMMARY OF THE DISCLOSURE

The present disclosure relates to a bow-mounted detecting system for a water vessel, such as a boat. The bow-mounted detecting system is configured to advantageously capture one or more images of a forward scene of the water vessel, including at least a portion of an anchor apparatus, for view by occupant(s) of the water vessel at a display device at a helm of the water vessel. In this manner, controlling the anchor apparatus between a deployed position and a retracted position (and vice versa) may be made safer, easier, and faster as occupant(s) of the water vessel is/are able to control the anchor apparatus while simultaneously viewing the anchor apparatus at the display device.

In some aspects, the bow-mounted detecting device includes a detecting device mounted on a bow of a water vessel and having a field-of-view directed forward, the detecting device being configured to capture one or more images of a forward scene within the field-of-view, the forward scene including at least a portion of an anchor apparatus of the water vessel; and a display device in communication with the detecting device, the display device being configured to receive the one or more captured images of the forward scene and sequentially display the one or more captured images.

In one or more embodiments, the present disclosure particularly can relate to water vessels with a bow-mounted detecting system. For example, the water vessel can comprise: an anchor apparatus positioned in or on a hull of the water vessel at about a bow thereof, the anchor apparatus being adapted for motorized deployment and retrieval of an anchor of the anchor apparatus; a camera positioned in or on the hull of the water vessel at about the bow thereof and having a forward-directed field-of-view, the camera being configured to capture one or more images of a forward scene within the field-of-view, the forward scene including at least a portion of the anchor of the anchor apparatus; and a display device separated from and in communication with the camera, the display device being adapted to receive the one or more captured images of the forward scene and to display the one or more captured images. In further embodiments, the water vessel may be defined in relation to one or more of the following statements, which may be combined in any number and order.

The anchor apparatus and the camera can be positioned in or on the hull of the water vessel so as to be each independently substantially horizontally centered across a central, vertical line defining a mid-point of the bow.

The anchor apparatus and the camera can be substantially vertically aligned.

The anchor apparatus can include one or more line guides, and the camera can be positioned horizontally below the one or more line guides.

The hull of the water vessel can include an anchoring aperture through which a line connected to the anchor extends and retracts, and the camera can be positioned horizontally below the anchoring aperture.

The hull of the water vessel can include a recess formed in bow thereof, and the camera can be positioned in or on the recess.

The recess can include a back wall and an overhang, and the camera can be positioned in or on the back wall of the recess and below the overhang.

The water vessel can be adapted or configured such that when the anchor is in a fully retracted position, the field-of-view of the camera can cover a vertical range from an uppermost aspect that includes at least a portion of the anchor to a lowermost aspect that includes at least to a plane extending to a waterline of the hull of the water vessel such that the anchor is at least partially visible at all points between the fully retracted position and a position wherein the anchor, while deployed, breaches a body of water in which the water vessel is positioned.

The camera can be a video camera.

The display device can be adapted to or configured to receive and display a live video feed from the camera.

The water vessel further can comprise an activation device adapted to or configured to cause the anchor to move at least between a retracted position and a deployed position relative to the hull of the water vessel.

The activation device and the camera can be electronically connected such that operation of the activation device automatically coincides with operation of the camera and the display device.

The activation device, the display device, and the camera can be electronically connected such that actuation of the activation device automatically turns on the camera and the display device such that movement of the anchor in substantially real time is visible on the display device.

In one or more embodiments, the present disclosure particularly can relate to methods for monitoring movement of an anchor at a bow of a water vessel. For example, such method can comprise: providing a water vessel as otherwise described herein; activating the display device to display the one or more captured images of the forward scene within the field-of-view as received from the camera; and activating the anchor apparatus so as to cause motorized deployment or retrieval of the anchor. In further embodiments, the method may be defined in relation to one or more of the following statements, which may be combined in any number and order.

The method further can comprise activating the camera to begin capture of the one or more images of a forward scene within the field-of-view.

The water vessel can comprise an activation device that is electronically connected with the display device, and activating the anchor apparatus can automatically cause activating of the display device.

These and other features, aspects, and advantages of the disclosure will be apparent from a reading of the following detailed description together with the accompanying drawings, which are briefly described below.

BRIEF DESCRIPTION OF THE FIGURES

Figure 1:
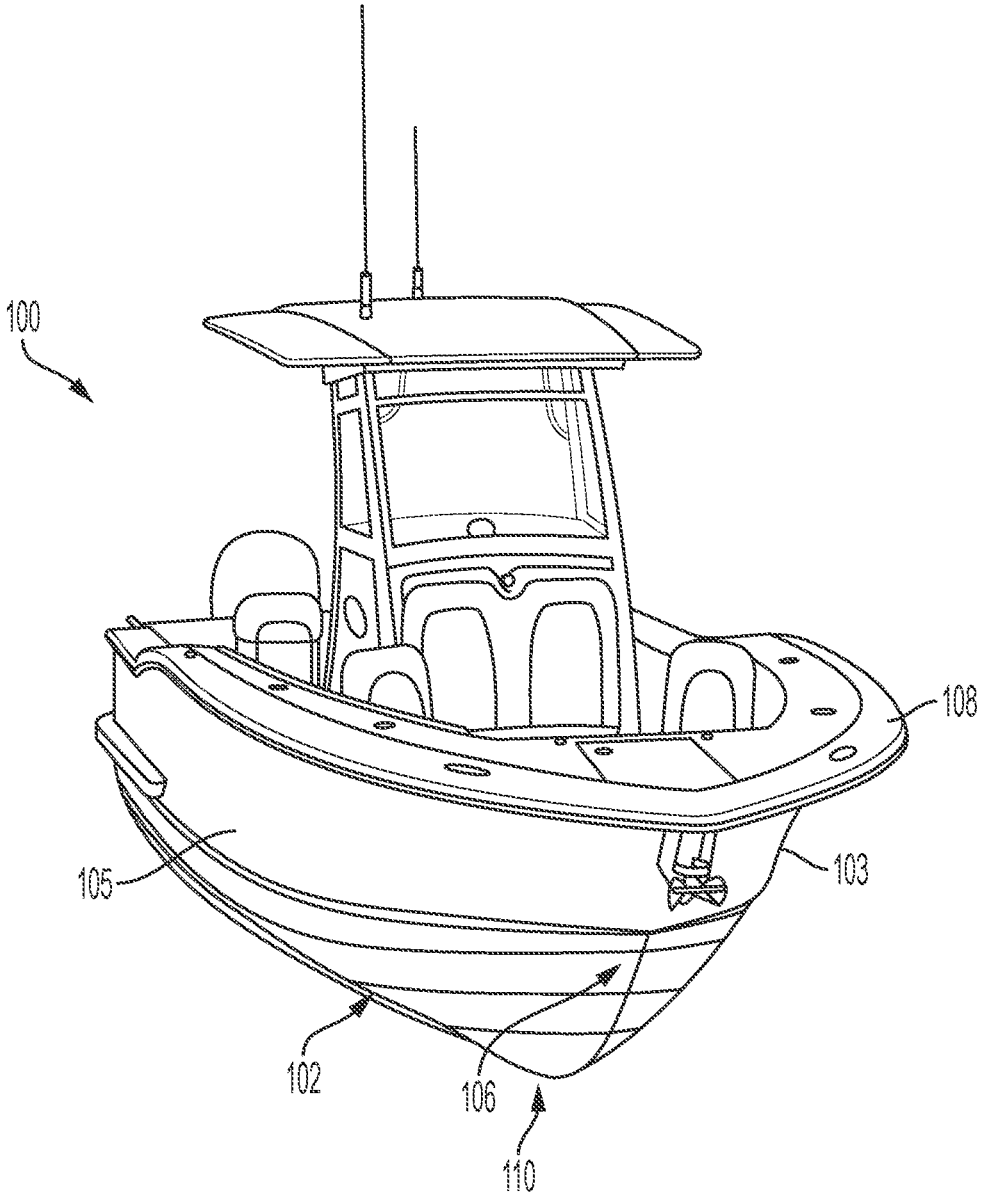
Figure 2:
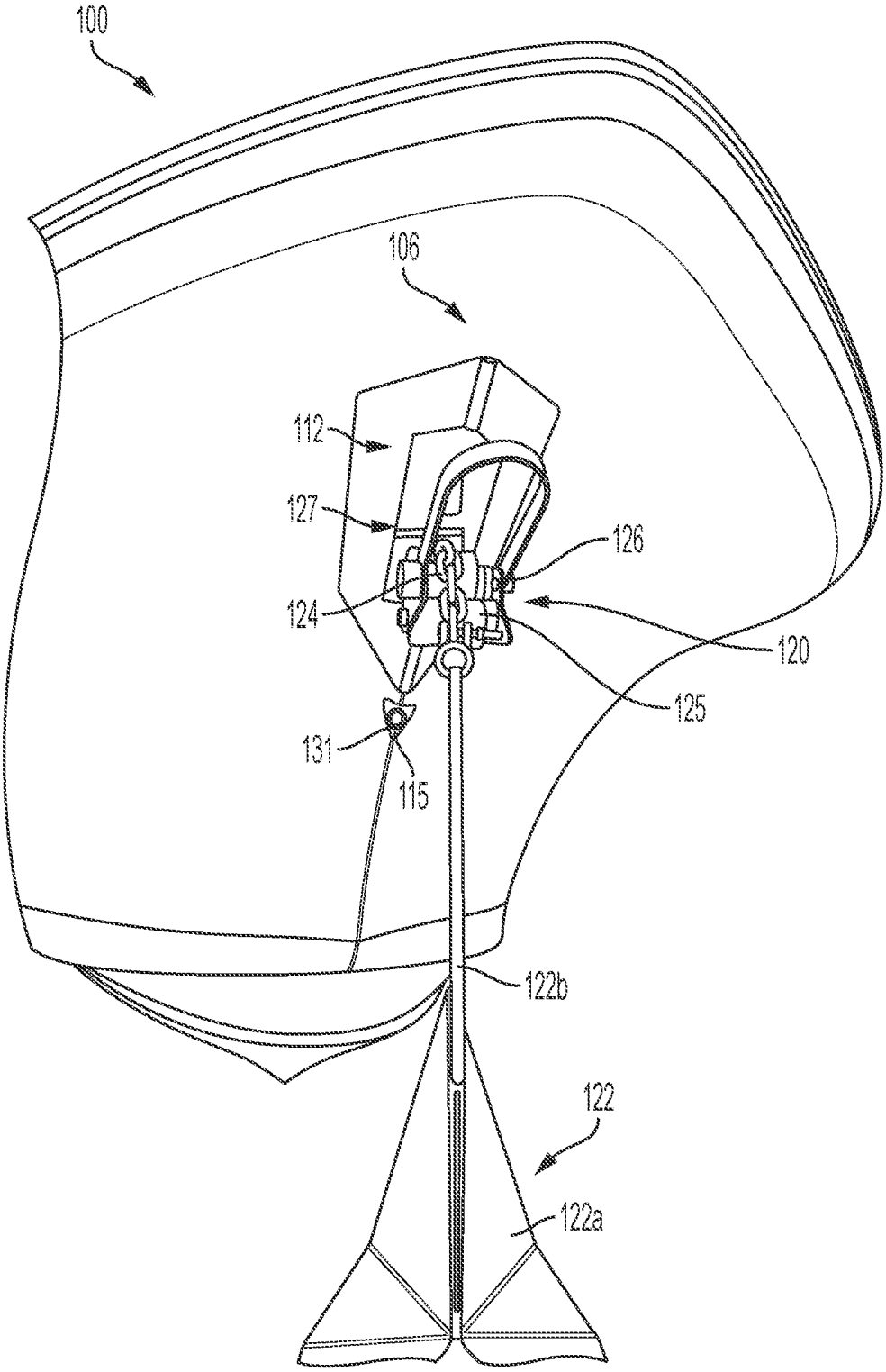
Figure 3:
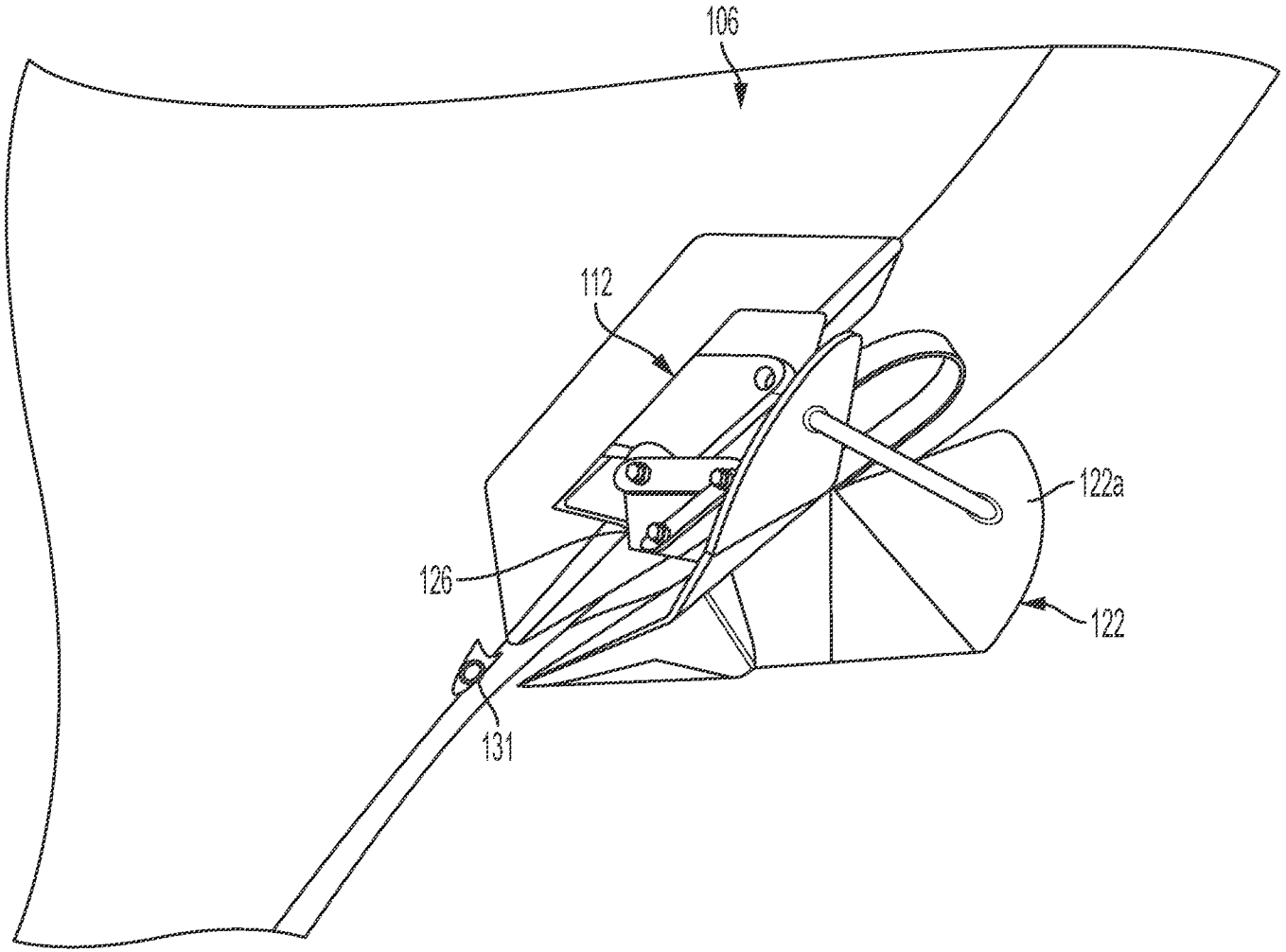
Figure 4:
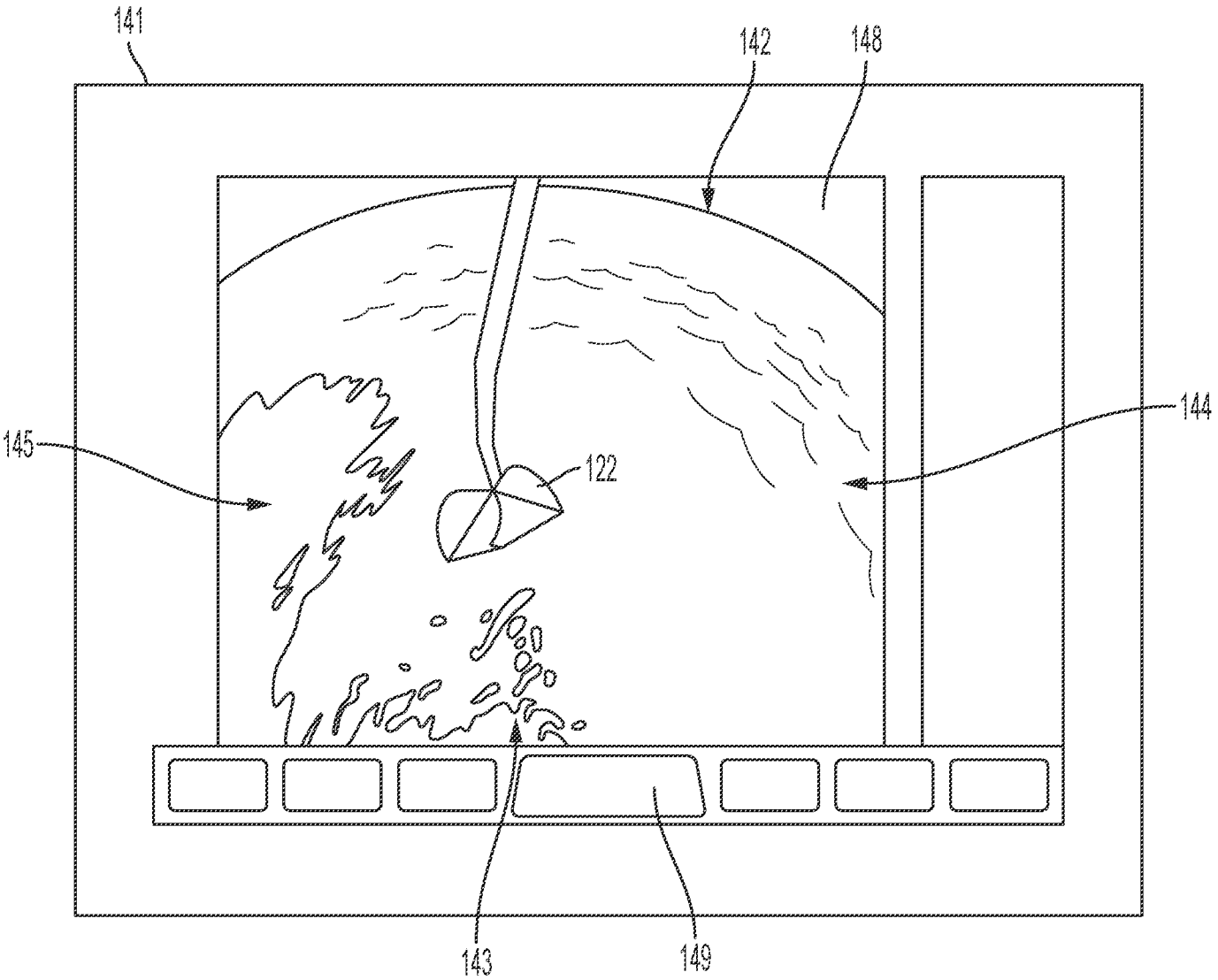
Figure 5:
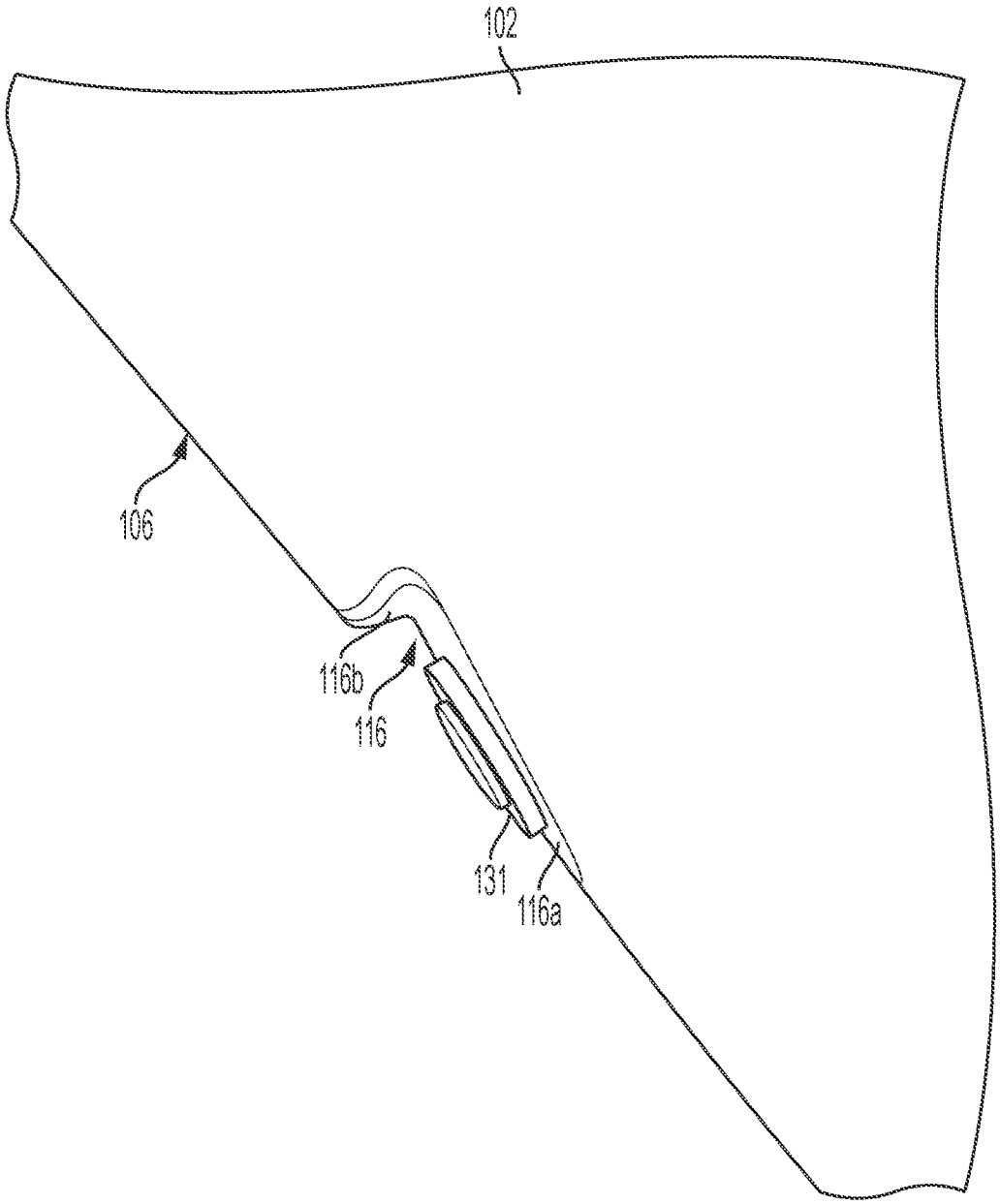
Figure 6:
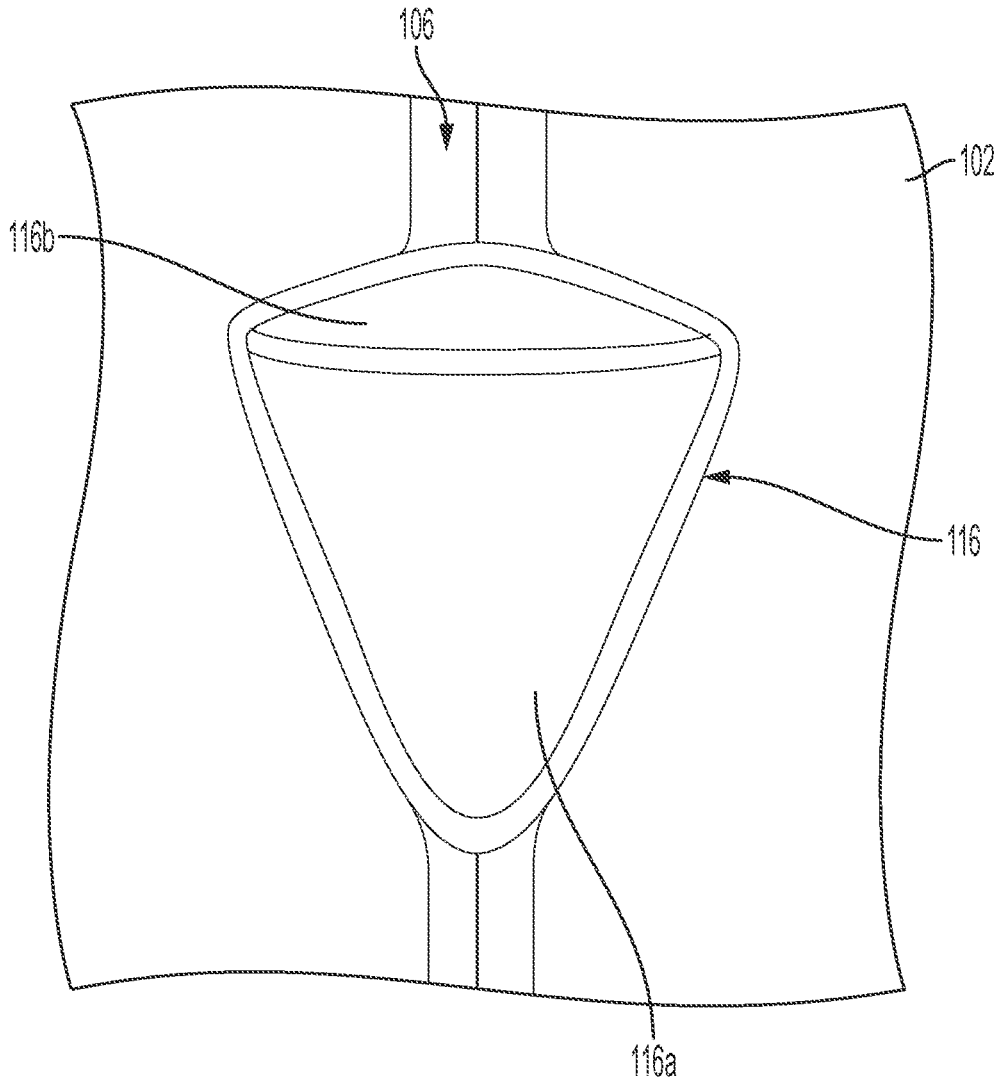
Figure 7:
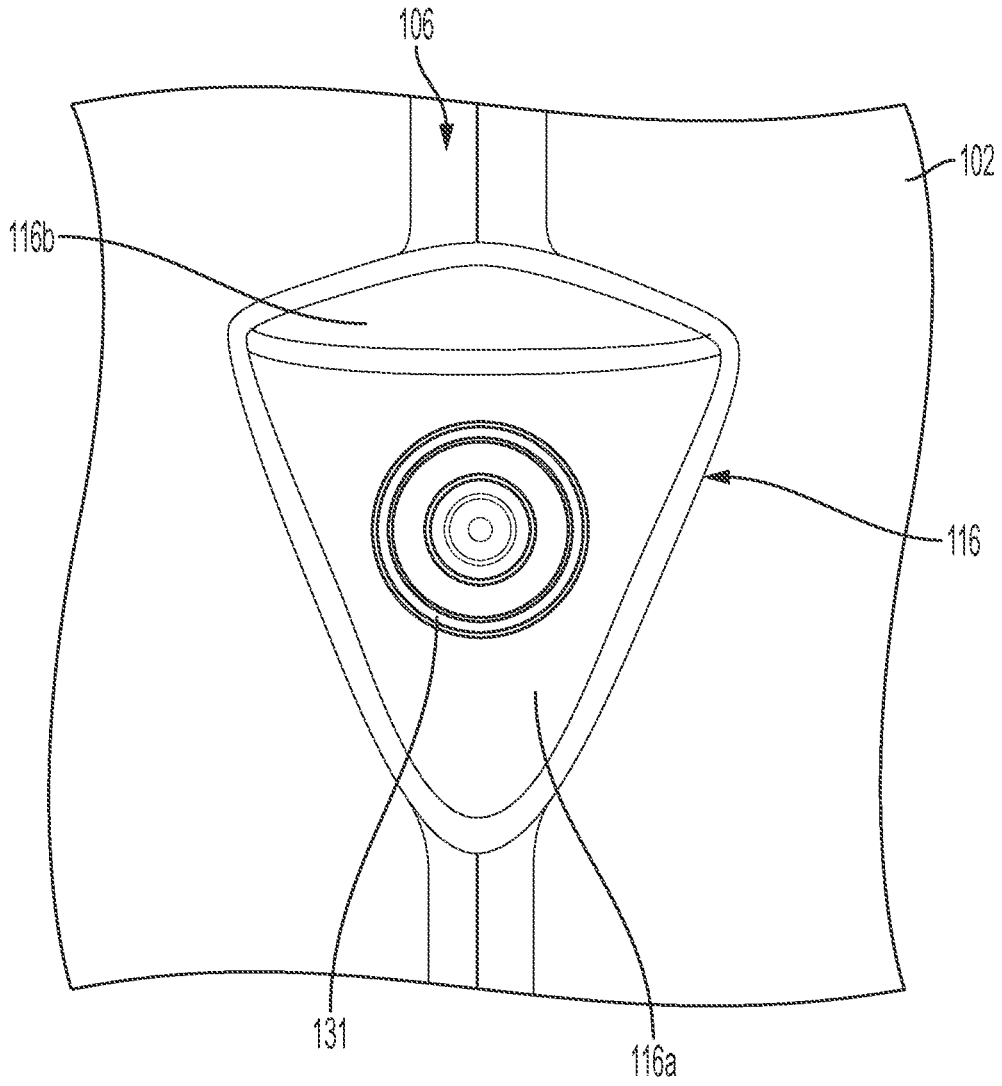
Figure 8:
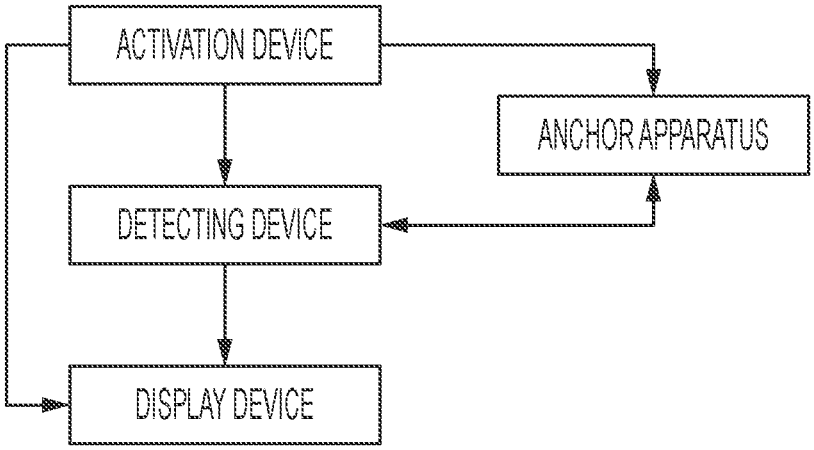

Having thus described the disclosure in the foregoing general terms, reference will now be made to the accompanying drawings, which are not necessarily drawn to scale, and wherein:

FIG. 1 illustrates a water vessel having a bow-mounted anchor apparatus;

FIG. 2 illustrates a water vessel according to an example embodiment of the present disclosure including an anchor apparatus with an anchor portion partially deployed and a bow-mounted detecting system;

FIG. 3 illustrates a detailed view of the water vessel of FIG. 2 wherein the anchor portion of the anchor apparatus is fully retracted;

FIG. 4 illustrates a detecting device for use with a detecting device according to an example embodiment of the present disclosure;

FIG. 5 illustrates a detailed view of a recess formed in a bow of a water vessel according to an example embodiment of the present disclosure wherein a detecting device is positioned;

FIG. 6 illustrates a front view of a bow of a water vessel according to an example embodiment of the present disclosure showing a recess wherein a detecting device may be positioned;

FIG. 7 illustrates a front view of a bow of a water vessel according to an example embodiment of the present disclosure showing a recess with a detecting device positioned therein; and FIG. 8 is a flowchart illustrating interactions between an activation device, an anchor apparatus, a detecting device, and a display device according to embodiments of the present disclosure.

DETAILED DESCRIPTION OF PREFERRED EMBODIMENTS

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural variations unless the context clearly dictates otherwise.

The present disclosure provides a water vessel with a bow-mounted detecting system. Such system is adapted to or configured to provide a user of the water vessel with real-time imaging of a forward-directed field of view, and the imaging is viewable from a position on the water vessel from which such field of view would not otherwise be visible.

In one or more embodiments, a water vessel with a bow-mounted detecting system can comprise an anchor apparatus positioned in or on a hull of the water vessel, and such positioning particularly can be about or around the bow of the water vessel. As such, it is understood that the bow of the water vessel refers to the forward portion of the hull of the water vessel. As shown in FIG. 1, a water vessel 100 can comprise a hull 102 with a port side 103 and a starboard side 105. The bow 106 can generally refer to the forward or front portion of the hull 102. As seen in FIG. 1, the hull 102 is configured so that the port side 103 and the starboard side 105 intersect at the bow 106. As illustrated in FIG. 1, a water vessel 100 having a generally "V-shaped" hull 102 can be configured such that the bow 106 defines approximately the leading edge of a vertical plane through the hull that is substantially aligned with a central, longitudinal axis of the water vessel 100. Thus, the bow 106 can expressly indicate a portion of a hull 102 of the water vessel 100 encompassing the central, vertical line extending down the front of the water vessel from the gunwale 108 of the hull to the keel 110 at the bottom of the water vessel (i.e., the "forward-most areas" of the hull), and the bow can further encompass an area of the hull extending a distance to either or both of the port side 103 and the starboard side 105 of the hull. More particularly, an element positioned in or on the water vessel 100 at the bow 106 can be substantially horizontally centered across the central, vertical line of the bow. In some embodiments, reference to an element being positioned "about or around" the bow 106 can indicate that the respective element is approximately at the forward-most areas of the hull 102 or in close proximity to the central, vertical line defining a mid-point of the bow. Being approximately at the forward-most position of the hull 102 or in close proximity to the forward-most position of the hull can mean being positioned at a location in or on the hull that is within about 15%, about 10%, about 5%, or about 1% of the overall width of the water vessel on either side of the central, vertical line defining the mid-point of the bow.

The anchor apparatus can be adapted to or configured to allow for motorized deployment and retrieval of an anchor. The anchor apparatus thus can comprise at least an anchor, a motorized windlass, and line connecting the anchor to the windlass. The line can include metal chain, metal cable, fiber rope, or a combination thereof. The windlass can be mounted interior to the hull of the water vessel and can include any motorized winching-type device commonly used in the field for motorized deployment and retrieval of an anchor, such as a drum anchor winch. The windlass preferably is configured to restrain and manipulate the anchor line to control the anchor between the retracted position (i.e., no anchor line is released and the anchor is disposed adjacent to the bow) and the deployed position (i.e., a controlled length of anchor line is released and the anchor is disposed at a position away from the bow).

Referring to FIG. 2, the anchor apparatus 120 is positioned at the bow 106 of the water vessel 100 and is substantially centrally positioned across the vertical mid-point of the bow. The anchor apparatus 120 comprises an anchor 122 that is formed of an anchor body 122*a* and a shank 122*b* that attaches the anchor to the anchor line 124. The anchor apparatus 120 can include one or more line guides 125, such as rollers (e.g., formed of metal and/or polymer materials), that can be adapted to or configured to align the anchor line 124 with the windlass as the anchor 122 is deployed or retrieved. As illustrated, a guide frame 126 can be used with the line guides 125 to provide support to the line guides and also ensure that the line does not become displaced from the guide(s). The windlass 127 is positioned within the hull 102, and the anchor line 124 passes from and to the windlass through a windlass aperture 112 (or an anchoring aperture) formed in the hull, the windlass aperture being substantially centrally positioned on the bow 106 with reference to the central, vertical line thereof. FIG. 2 illustrates the anchor 122 in a partially deployed position, while FIG. 3 illustrates the anchor in a fully retracted position.

In addition to the anchor apparatus, a water vessel according to the present disclosure includes at least one detecting device that is also positioned in or on the hull of the water vessel at about the bow of the water vessel. The detecting device preferably is spaced at a distance apart from the anchor apparatus and mounted directionally below the anchor apparatus towards the keel of the water vessel. The detecting device can be, for example, a camera, and preferably is a video camera. The detecting device may include any type of device capable of capturing images such as, but not limited to, photographs, videos, and a combination thereof. The detecting device may thus include an optical scanner, a visible light camera, a video camera, an infrared camera, and the like.

The detecting device may comprise a field-of-view that is directed forward, i.e., towards a front of the water vessel, and the detecting device may be configured to capture one or more images of a forward scene within the field-of-view within a given period of time. The detecting device (e.g., camera) specifically is positioned so as to have a forward-directed field-of-view. As seen in FIG. 2 and FIG. 3, a camera 131 is positioned in or on a camera recess 115 formed in the hull 102 of the water vessel, such camera recess being further described below. The camera 131 thus is substantially centrally positioned across the vertical mid-point of the bow 106 so as to provide the easiest and best forward-directed field-of-view available. If desired, the camera 131 may be positioned in or on the bow 106 of the hull 102 substantially to one side or the other of the vertical midpoint, such as within an area of the bow as otherwise described above. In preferred embodiments, however, the camera 131 is beneficially positioned as illustrated in the Figures to achieve the best functional use as described herein. The camera is adapted to or configured to capture one or more images of a forward scene within the field-of-view, the forward scene including at least a portion of the anchor 122 of the anchor apparatus 120. The benefit of such positioning is further described below.

The water vessel with a bow-mounted detecting system further includes a display device 141. The display device 141 can be separated from and in communication with the camera 131 (or other detecting device) so that the one or more images captured by the camera may be viewed remotely from the camera. For example, an individual operating the water vessel at the helm on the deck of the water vessel will thus be able to see the forward-directed field-of-view without the necessity of standing atop the bow of the water vessel. As such, the display device is adapted to or configured to receive the one or more captured images of the forward scene and to display the one or more captured images. Preferably, the display device 141 is a video monitor that is adapted to receive and display a live video feed that can be received from the camera 131.

The disposition of the camera 131 (or other detecting device) and the anchor apparatus 120 may be such that at least a portion of the anchor apparatus is in the forward scene of the field-of-view of the camera. In one or more embodiments, as further described herein, the combination of the detecting device with the anchor apparatus provides the distinct benefit of allowing for real-time monitoring of the deployment and retrieval of the anchor without the requirement of a person being physically stationed over the bow of the water vessel. In relation to operation of motorized anchor apparatus, it is common for the windlass controls to be positioned at the helm of the water vessel, which is typically positioned on the deck of the water vessel and spaced significantly in an aft direct direction from the bow. As such, the person operating the windlass controls typically is not in a physical position to visually monitor movement of the anchor, and another individual may be needed to look over the gunwale at the bow of the water vessel to monitor movement of the anchor. According to the present disclosure, however, a single individual operating the windlass from the helm of the water vessel (or another position on the water vessel remote from the anchor apparatus) is thus able to visually monitor movement of the anchor to ensure that the anchor is properly deployed and/or retrieved.

The foregoing benefits may be achieved at least in part due to the placement of both of the anchor apparatus and the camera in or on the hull of the water vessel at the bow of the hull. Preferably, both of the anchor apparatus and the camera are present in or on the hull of the water vessel substantially at the central, vertical line defining the mid-point of the bow (e.g., so as to be each independently substantially horizontally centered across the central, vertical line defining the mid-point of the bow). As such, it can be preferable for the anchor apparatus and the camera to be substantially vertically aligned. Such alignment can provide for a desired field-of-view wherein the anchor of the anchor apparatus is substantially centrally aligned within the forward-facing view so that movement of the water vessel during deployment of the anchor may not move the anchor line and/or the anchor out of the field-of-view of the camera. Being substantially centrally aligned can indicated that a central vertical axis of the camera and a central vertical axis of the anchor apparatus (or a central vertical axis of the anchor specifically) are off-centered by no more than about 1 cm, no more than about 2 cm, no more than about 5 cm, or no more than about 10 cm. If desired, however, the camera and the anchor apparatus may be off-centered relative to one another by a significant amount (e.g., greater than about 10 cm). In such instances, it is preferred that the camera is positioned (e.g., angled or the like) so that the anchor remains substantially centrally located within the field-of-view of the camera.

In addition to have a vertical alignment relationship, it also can be preferable for the camera and the anchor apparatus (or a specific portion thereof) to have a defined horizontal relationship. In particular, it can be preferable for the camera to be positioned horizontally below the anchor apparatus. In certain embodiments, as seen in FIG. 2, this can mean that the camera 131 is positioned horizontally below the one or more line guides 125 of the anchor apparatus 120. In other embodiments, the camera specifically can be positioned horizontally below the windlass aperture 112 formed in the hull 102 of the water vessel.

As seen from the foregoing, it can be particularly beneficial for the camera and the anchor apparatus to be substantially aligned in a vertical plane at the bow of the water vessel such that the camera is horizontally below the anchor apparatus or a specific portion thereof. Other alignments are also encompassed by the present disclosure. Preferably, however, any alignment of the camera and the anchor apparatus is adapted to or configured to provide a desired view of the anchor. For example, it is desirable for the alignment to be such that when the anchor is in a fully retracted position, the field-of-view of the camera covers a vertical range from an uppermost aspect that includes at least a portion of the anchor to a lowermost aspect that includes at least to a plane extending to a waterline of the hull of the water vessel. In this manner, the anchor is at least partially visible at all points between the fully retracted position and a position wherein the anchor, while deployed, breaches a body of water in which the water vessel is positioned. Referring to FIG. 4, the display device 141 includes a monitor screen 148 with a field of view defined by an uppermost aspect 142, a lowermost aspect 143, a starboard aspect 144, and a port aspect 145. In FIG. 4, the anchor 122 is in the process of deployment and is substantially centered in the monitor screen 148. During deployment, the anchor 122 thus will breach the water line before moving below the lowermost aspect 143 of the monitor screen 148, and during retrieval, the anchor will be fully retrieved before moving above the uppermost aspect 142 of the monitor screen.

More particularly, FIG. 4 illustrates how the detecting device is adapted to or configured to capture one or more images of the forward scene including at least a portion of the anchor apparatus whether the anchor is fully retracted or is in a position between being fully retracted and being deployed below the water surface. The display device 141 can be adapted to or configured to include any output device for presentation of information in a visual or tactile form. The display device can be a light-emitting diode (LED) device, an organic light-emitting diode (OLED) device, a liquid crystal display (LCD) device, and the like. The display device can also be touch-screen to enable occupant (s) of the water vessel to interact with the display device by touch. Alternatively, the display device 141 can include one or more buttons 149 or the like configured to adjust and/or control the display device. Further, the display device can be solely dedicated to working with the detecting device, or the display device can be adapted to or configured to be used for multiple purposes—e.g., displaying water depth, heading coordinates, global positioning satellite (GPS) information, vessel speed, or the like.

As discussed above, in some embodiments, the camera (or other detecting device) can be positioned in or on a recess formed in the hull 102 at the bow 106 thereof. The recess specifically is configured so as not to inhibit a field-of-view of the detecting device. For example, as illustrated in FIGS. 2, 3, and 5-7, the bow 106 of the water vessel 100 may be configured so as to define a concave, triangularly-shaped recess that is sized to receive the camera 131 (or other detecting device) therein. More particularly, FIG. 5 illustrates the recess 116 being formed as a concave recess off the angular bow 106, having a depth that decreases towards the keel of the water vessel. In some aspects, a maximum depth of the recess is about 0.1 inches (0.254 cm) to about 2 inches (5.08 cm), about 0.2 inches (0.508 cm) to about 1.5 inches (3.81 cm) or about 0.25 inches (0.635 cm) to about 0.75 inches (1.905 cm) deep. The recess 116 further can define a constant decrease in depth towards the keel of the water vessel. As such, the recess 116 can include a back wall **116*a* and an overhang 116*b* formed by the hull 102 of the water vessel, and the camera can be positioned in or on the back wall of the recess and below the overhang. FIG. 6 illustrates a front view of the recess 116. As illustrated from the front view, back wall 116*a* of the recess 116 has a width extending between port and starboard sides of the water vessel, and the width of the back wall of the recess decreases between port and starboard sides of the hull moving directionally downward from the overhang 116*b* towards the keel of the water vessel. In some aspects, a maximum width of the recess 116 is about 1 inch (2.54 cm) to about 5 inches (12.7 cm), about 1.5 inches (3.81 cm) to about 4 inches (10.16 cm) or about 2.0 inches (5.08 cm) to about 2.5 inches (6.35 cm) wide. Preferably, the decrease in the width of the recess 116 across the back wall 116*a* is substantially constant moving from the overhang 116*b* towards the keel of the water vessel. Additionally, the recess has a height between keel and gunwale, with a substantially symmetrical decrease in height on either side (i.e., port and starboard) of a central axis running along an angle of the bow. In some embodiments, a maximum height of the recess 116** is about 1 inch (2.54 cm) to about 5 inches (12.7 cm), about 2 inches (5.08 cm) to about 3.5 inches (8.89 cm), or about 2.25 inches (5.715 cm) to about 2.75 inches (6.985 cm) tall, with a constant decrease in height on either side of the central axis towards port and starboard.

The camera (or other detecting device) can be sized to fit within the substantially triangular recess 116 either by mounting or some other positioning (e.g., gluing, press-fitting, etc.), such that a field-of-view of the detecting device is not impeded or impacted by the recess of the angled bow. As such, as further described device, the detecting device is configured to monitor the anchor apparatus, as well as monitor the horizon and a water surface below the bow (e.g., when docking, beaching, trailering, etc.) for any objects in a forward path of the water vessel.

In one or more embodiments, the water vessel can be adapted to or configured to provide for automated control of one or more of the anchor apparatus, the detecting device, and/or the display device. Automated control can relate to activation of the detecting device and/or activation of the display device as a result of activation of the anchor apparatus. For example, the water vessel or a component thereof may include an automated control component that is in electronic communication with the windlass or with some other aspect of the anchor apparatus. The electronic control component may be directly associated with the windlass or other component of the anchor apparatus, or the electronic control component may be included with a further component of the water vessel as discussed below. As such, in one or more embodiments, a water vessel as described herein may include an activation device as shown in FIG. 8 that is adapted to or configured to interact electronically with one or more of the anchor apparatus, the detecting device, and the display device.

In some embodiments, the activation device can be adapted to or configured to cause the anchor to move at least between a retracted position and a deployed position relative to the hull of the water vessel. For example, the activation device can include a switch and/or an electronic equivalent thereof that is electronically connected with the windlass and is thus configured to actuate one or both of deployment and/or retrieval of the anchor. As seen in FIG. 4, an activation device may be related to one or more of the buttons 148 of the display device. Alternatively, additional buttons may be included with control components present at the helm of the water vessel, and the activation device may be associated with one or more of said additional buttons. One or both of the detecting device and the display device can be adapted to or configured to be automatically engaged in response to actuation of the windlass. More particularly, the detecting device and the display device may remain in an off mode, sleep mode, or the like until the activating device actuates the windlass. The actuation of the windlass can automatically cause the detecting device and the display device to enter an operating mode where the detecting device is capturing one or more images of a forward scene within the field-of-view thereof, and the display device is receiving and displaying the one or more captured images of the forward scene. If desired, the detecting device may be configured to in the operating mode (and thus be capturing one or more images of a forward scene within the field-of-view thereof) whenever power is being delivered thereto, and the water vessel may be adapted or configured such that actuation of the windlass can automatically cause the display device to enter an operating mode where the display device is receiving and displaying the one or more captured images of the forward scene. In some embodiments, the display device may be adapted to or configured to provide display functions in addition to displaying the one or more captured images of the forward scene. Thus, the display device can be adapted to or configured to automatically switch from an existing display to displaying the one or more captured images of the forward scene from the detecting device when the windlass is actuated via the activation device. In such embodiments, the water vessel can be adapted to or configured to operate such that motorized deployment of the anchor and/or motorized retrieval of the anchor automatically switches one or both of the detecting device and the display device to a mode where the camera is capturing one or more images of a forward scene within the field-of-view and the display device is receiving and displaying the one or more captured images. In an example embodiment, the activation device, the display device, and the camera are electronically connected such that actuation of the activation device automatically turns on the camera and the display device such that movement of the anchor in substantially real time is visible on the display device.

The activation device may include a computing platform having a hardware processor and a memory, and may be configured to control (via software executable by the hardware processor) the anchor apparatus, the detecting device, and the display device. The computing platform may comprise a least one integrated circuit including one or more control components that are adapted to or configured to electronically control the anchor apparatus (particularly operation of the windlass), the detecting device, and the display device. The electronic control can include one or more manual switches or the like that can be actuated by a used to initiate a sequence of control functions for integration between the anchor apparatus, the detecting device, and the display device. Likewise, electronic control can include one or more internal, electronic switches or the like that can be automatically controlled by software and the hardware processor to propagate the sequence of control functions for integration between the anchor apparatus, the detecting device, and the display device. As such, the circuitry and control components can be adapted to or configured to control the movement of the anchor between at least a retracted position and a deployed position, to control operation of the detecting device to capture one or more images of a forward scene within the field-of-view, and to control operation of the display device to display the one or more captured images.

The display device, the camera, and any circuitry and control components may be in communication via any suitable components. For example one or more of said elements may be connected by wiring as would be recognized in the field to provide for communications and data transfer therebetween. Moreover, one or more communication interfaces may be provided in order to enable communication with one or more networks or other devices (e.g., computers and/or mobile devices). The communication interface may include, for example, an antenna (or multiple antennas) and supporting hardware and/or software for enabling communications with a wireless communication network (e.g., a cellular network, Wi-Fi, WLAN, and/or the like) and/or for supporting a wireless communication link (e.g., proximity-based communication link). For example, the communication interface may be configured to support various wireless, proximity-based device-to-device communication technologies, such as those described above. In some examples, the communication interface may include a communication modem, a physical port (e.g., a serial port) for receiving a wired communication cable, and/or other hardware/software for supporting communication via cable, digital subscriber line (DSL), USB, FireWire, Thunderbolt, Ethernet, one or more optical transmission technologies, and/or other wired communication technology that may be used to implement a wired communication link. One or more elements as described herein likewise or alternatively may be paired to establish a proximity-based communication link between the devices to allow wireless communication between them (e.g., between a camera and a display device). This proximity-based communications link may be supported by one or more of a number of different proximity-based, device-to-device communication technologies. Examples of suitable technologies include various near field communication (NFC) technologies, wireless personal area network (WPAN) technologies and the like. More particular examples of suitable WPAN technologies include those specified by IEEE 802.15 standards or otherwise, including Bluetooth, Bluetooth low energy (Bluetooth LE), ZigBee, infrared (e.g., IrDA), radio-frequency identification (RFID), Wireless USB and the like. Yet other examples of suitable proximity-based, device-to-device communication technologies include Wi-Fi Direct, as well as certain other technologies based on or specified by IEEE 802.11 standards and that support direct device-to-device communication.

In some aspects, the display device is in communication with the detecting device (e.g., by way of electrical communication) in order to receive one or more captured images from the detecting device. In this manner, the display device is configured to receive the one or more captured images of the forward scene and sequentially display the one or more captured images.

In some further aspects of the disclosure, the sequential display of the one or more captured images is dependent on the activation device. More particularly, the activation device is configured to control the anchor apparatus between at least the retracted position and the deployed position relative to the bow (and thus to the detecting device). As such, the activation device is configured to automatically actuate the detecting device to capture the one or more images of the forward scene within the field-of-view in response to the anchor apparatus moving between the two positions. In this manner, the display device only sequentially displays the one or more captured images upon actuation of the detecting device via the activation device.

A substantial advantage of the present disclosure is the ability to link a visual display on the deck of the water vessel with movement of the anchor off the bow of the water vessel through a detecting system that is positioned on the bow in relative proximity to the anchor apparatus. Electronic linking between the anchor apparatus, the detecting system, and the display system, optionally with a manually actuated activation device, provides the ability to automatically view real-time movement of the anchor off the bow of the water vessel on a display device that is positioned on the deck of the vessel, generally at a position from which movement of the anchor would not otherwise be possible. "One touch" capability to operate the windlass and automatically switch on display of real-time images from a detecting device on the bow of the water vessel such that movement of the anchor can be monitored from the deck of the water vessel provides a distinct advantage. The present disclosure, however, also provides the capability for separate operation of the anchor apparatus, the detecting device, and the display device.

In one or more embodiments, the present disclosure can provide methods for monitoring movement of an anchor at a bow of a water vessel. The methods can be carried out in relation to operation of a water vessel according to one or more embodiments as otherwise described herein. For example, a method can comprise activating a display device to display one or more captured images of a forward scene within a field-of-view as received from a detecting device, and also activating an anchor apparatus so as to cause motorized deployment or retrieval of the anchor. If the detecting device is not adapted or configured to be operating even when captured images are not displayed by the display device, the method may further comprise activating the display to begin capture of the one or more images of a forward scene within the field-of-view.

The steps of activating the anchor apparatus, activating the display device, and activating the detecting device may be separately carried out by a user, or any combination of two of the noted steps may be linked. For example, activating the anchor apparatus and activating the detecting device may be separately and manually activated by a user, and activating the display device may be automatically carried out by electronic control in response to activation of the anchor apparatus or the detecting device. As another example, activating the anchor apparatus and activating the display device may be separately and manually activated by a user, and activating the detecting device may be automatically carried out by electronic control in response to activation of the anchor apparatus or the detecting device. In preferred embodiments, activating of the anchor apparatus can, via electronic controls, cause automated activating or switching of the display device. Thus, the display device may automatically be activated to be change from an off or sleep mode to a display mode, or the display device may automatically be switched from display of a first type of media to display of the one or more images of a forward scene within the field-of-view. Likewise, activating of the anchor apparatus can, via electronic controls, cause automated activating of the detecting device. More particularly, the water vessel can comprise an activation device that is electronically connected with the display device (and/or the detecting device), and activating the anchor apparatus can automatically cause activating of the display device (and/or the detecting device).

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A water vessel with a bow-mounted detecting system, the water vessel comprising:

an anchor apparatus positioned in or on a hull of the water vessel at about a bow thereof, the anchor apparatus being adapted for motorized deployment and retrieval of an anchor of the anchor apparatus;

a detecting device positioned in or on the hull of the water vessel at about the bow thereof and above a waterline of the hull, the detecting device positioned so as to capture one or more images of a forward scene of the water vessel within a field-of-view of the detecting device; and a display device separated from and in communication with the detecting device, the display device being adapted to receive the one or more captured images of the forward scene and to display the one or more captured images.

2. The water vessel of claim, 1, wherein the detecting device is positioned so as the field-of-view of the detecting device covers a vertical range from an uppermost aspect that includes at least a portion of the anchor to a lowermost aspect that includes at least the waterline of the hull of the water vessel.

3. The water vessel of claim 1, wherein the detecting device is configured to monitor the horizon and a water surface below the bow for any objects in a forward path of the water vessel, and the display device is positioned at the helm and is adapted to receive and display a live video feed of the forward path of the water vessel from the detecting device.

4. The water vessel of claim 1, wherein the detecting device comprises at least one of an optical scanner, a visible light camera, a video camera, an infrared camera, or a combination thereof.

5. The water vessel of claim 1, wherein the anchor apparatus and the detecting device are substantially vertically aligned.

6. The water vessel of claim 1, wherein the hull of the water vessel includes a recess formed in the bow thereof and the detecting device is positioned in or on the recess.

7. The water vessel of claim 2, wherein the detecting device is positioned such that the anchor is at least partially visible at all points between a fully retracted position and a position where the anchor, while deployed, breaches a body of water in which the water vessel is positioned.

8. The water vessel of claim 1, wherein the display device is adapted to receive and display a live video feed from the detecting device.

9. The water vessel of claim 1 further comprising an activation device adapted to cause the anchor to move between a retracted position and a deployed position, wherein the activation device is in electronic communication with the detecting device and the display device to enable automatic operation thereof and to provide real time images of the movement of the anchor on the display device.

10. The water vessel of claim 2, wherein the display device is positioned at the helm.

11. The water vessel of claim 10, wherein the display device is configured to also display at least one of water depth, heading coordinates, global positioning satellite (GPS) information, vessel speed, or a combination thereof.

12. The water vessel of claim 10, wherein the display device comprises one or more controls configured to adjust the display, control the display, or to activate at least one of the anchor apparatus, the detecting device, or the display device.

13. The water vessel of claim 1 further comprising a computing platform having a hardware processor and a memory and configured to automatically control the anchor apparatus, the detecting device, and the display device.

14. The water vessel of claim 13, wherein the computing platform is configured to control the movement of the anchor between at least the retracted position and the deployed position, to control operation of the detecting device to capture the one or more images of a forward scene within the field-of-view, and to control operation of the display device to display the one or more captured images.

15. The water vessel of claim 1, wherein the display device comprises a touch screen.

* * * * *